US008598514B2

(12) United States Patent
Robb

(10) Patent No.: US 8,598,514 B2
(45) Date of Patent: Dec. 3, 2013

(54) AP-ECD METHODS AND APPARATUS FOR MASS SPECTROMETRIC ANALYSIS OF PEPTIDES AND PROTEINS

(75) Inventor: Damon B. Robb, Vancouver (CA)

(73) Assignee: The University of British Columbia, Vancouver, British Columbia (CA)

( * ) Notice: Subject to any disclaimer, the term of this patent is extended or adjusted under 35 U.S.C. 154(b) by 245 days.

(21) Appl. No.: 13/203,142

(22) PCT Filed: Feb. 23, 2010

(86) PCT No.: PCT/CA2010/000215

§ 371 (c)(1),
(2), (4) Date: Aug. 24, 2011

(87) PCT Pub. No.: WO2010/096904

PCT Pub. Date: Sep. 2, 2010

(65) Prior Publication Data

US 2011/0303839 A1 Dec. 15, 2011

Related U.S. Application Data

(60) Provisional application No. 61/202,421, filed on Feb. 26, 2009.

(51) Int. Cl.
*H01J 49/42* (2006.01)
*H01J 49/26* (2006.01)

(52) U.S. Cl.
USPC ..... 250/282; 250/281; 250/288; 250/287; 250/423 R

(58) Field of Classification Search
USPC ..... 250/282, 283, 281, 294
See application file for complete search history.

(56) References Cited

U.S. PATENT DOCUMENTS

| | | | | |
|---|---|---|---|---|
| 6,781,117 | B1 | 8/2004 | Willoughby et al. | |
| 6,919,562 | B1 | 7/2005 | Whitehouse et al. | |
| 7,518,108 | B2 | 4/2009 | Frey et al. | |
| 7,723,676 | B2 * | 5/2010 | Vilkov et al. | 250/281 |
| 8,129,675 | B2 * | 3/2012 | Schultz et al. | 250/282 |
| 8,188,423 | B2 * | 5/2012 | Doroshenko et al. | 250/281 |
| 2004/0232324 | A1 | 11/2004 | Berkout et al. | |
| 2005/0199804 | A1 | 9/2005 | Hunt et al. | |
| 2009/0152458 | A1 * | 6/2009 | Vilkov et al. | 250/282 |
| 2010/0288920 | A1 * | 11/2010 | Doroshenko et al. | 250/282 |

FOREIGN PATENT DOCUMENTS

EP 1598850 A2 11/2005

OTHER PUBLICATIONS

International Search Report for PCT/CA2010/000215, Completed by the Canadian Patent Office on Apr. 7, 2010, 2 Pages.
Robb et al. "Atmospheric Pressure Photoionization: An Ionization Method for Liquid Chromatography-Mass Spectrometry", Anal. Chem. 2000, vol. 72, p. 3653-3659.
Delobel et al. "Characterization of Hydrophobic Peptides by Atmospheric Pressure Photoionization-Mass Spectrometry and Tandem Mass Spectrometry", Anal. Chem. 2003, vol. 75, p. 5961-5968.
Cooper et al. "The Role of Electron Capture Dissociation in Biomolecular Analysis", Mass Spectrometry Reviews, 2005, vol. 24, p. 201-222.
Syage et al. "Atmospheric pressure photoionization II. Dual source ionization", Journal of Chromatography A 2004, vol. 1050, p. 137-149.
Debois et al. "Fragmentation induced in atmospheric pressure photoionizaztion of peptides", Journal of Mass Spectrometry 2006, vol. 41, p. 1554-1560.
Robb et al. "An electropneumatic-heated nebulizer for enhancing spray ionization in PhotoSpray atmospheric pressure photoionization sources for liquid chromatography/mass spectrometry", Rapid Communications in Mass Spectrometry 2009, vol. 23, p. 3394-3400.
Syka et al. "Peptide and protein sequence analysis by electron transfer dissociation mass spectrometry", PNAS Jun. 29, 2004, vol. 101, No. 26, p. 9528-9533.
Zubarev et al. "Electron Capture Dissociation of Multiply Charged Protein Cation. A Nonergodic Process", J. Am. Chem. Soc. 1998, vol. 120, p. 3265-3266.

* cited by examiner

*Primary Examiner* — Nikita Wells
*Assistant Examiner* — Johnnie L Smith
(74) *Attorney, Agent, or Firm* — Brooks Kushman P.C.

(57) ABSTRACT

An in-source atmospheric pressure electron capture dissociation (AP-ECD) method and apparatus for mass spectrometric analysis of peptides and proteins. An electrified sprayer generates a multiply-charged peptide/protein ions from a sample solution, a source of electrons for negative reagents, and a flow of gas for guiding positively charged ions from the electrified sprayer to a downstream reaction region within the guide. The reaction region being at or near atmospheric pressure and substantially free of the electric field from the electrified sprayer. In another embodiment, the method uses electron transfer dissociation (ETD), in the event that anions are substituted for electrons as the negative reagents. Fragment ions exiting the reaction region are subsequently passed into a mass analyzer of a mass spectrometer for mass analysis of the ions.

20 Claims, 4 Drawing Sheets

AP-ECD METHODS AND APPARATUS FOR MASS SPECTROMETRIC ANALYSIS OF PEPTIDES AND PROTEINS

CROSS-REFERENCE TO RELATED APPLICATION

This application is the U.S. national phase of PCT Appln. No. PCT/CA2010/000215 filed Feb. 23, 2010 which claims the benefit of U.S. provisional application 61/202,421 filed Feb. 26, 2009, the disclosures of which are incorporated in their entirety by reference herein.

FIELD OF THE INVENTION

This invention relates to the field of mass spectrometry. This invention also relates to the structural characterization of compounds including peptides and proteins by mass spectrometry. More particularly, this invention is concerned with both a method and apparatus for providing improved creation and fragmentation of compounds including peptide and protein ions at or near atmospheric pressure, for subsequent analysis in a mass spectrometer.

BACKGROUND OF THE INVENTION

Protein characterization plays a central role in diverse areas of biological and biomedical research. Much of this characterization involves mass spectrometric analyses, capable of providing information on both the primary sequence and the post-translational modifications (PTMs) of a protein or its peptides. Knowledge of the primary sequence of a protein is important for establishing its identity, while knowledge of PTMs is crucial for understanding many aspects of its cellular functions.

Collision induced dissociation (CID) is a method commonly used in mass spectrometric analyses of proteins, being useful for fragmenting peptides prior to detection, ultimately allowing for their amino acid sequences to be elucidated, at least partially if not completely. PTMs can also be analyzed by CID, through various means, but the site of PTMs on peptides/proteins often cannot be determined. Complete sequence and PTM-site information for peptides often cannot be obtained through CID because of the slow-heating nature of its mechanism, in which peptide ions are gradually heated through multiple collisions with neutral gas species, with each collision adding to the internal energy of the peptide. The time-scale for these collisions is slow relative to the time for the induced vibrational energy of the peptide ion to be distributed throughout the molecule, and as a consequence weaker bonds are fragmented preferentially. Since not all bonds between amino acid residues are of the same strength, not all are broken, and so gaps arise in the sequence information obtainable by CID. Likewise, labile PTMs are frequently lost prior to dissociation of the main peptide backbone, so that fragment sections of the backbone no longer bear the PTMs, preventing localization of their sites on the peptide. Hence, even though CID has many favorable attributes, its nature inherently limits the information it can provide in structural characterization of peptides/proteins, prompting the development of alternate fragmentation methods.

Two new methods of peptide/protein fragmentation have recently been developed—electron capture dissociation (ECD) and electron transfer dissociation (ETD)—which can provide information complementary to that obtainable by CID. Significantly, both ECD and ETD induce fragmentation non-ergodically, i.e., without energy randomization in a molecule. This characteristic results in ECD and ETD inducing fragmentation essentially evenly along the peptide/protein backbone, independent of bond strength, providing more complete sequence information than CID. Further, labile PTMs are generally preserved during the fragmentation step, permitting the routine determination of their sites.

Electron capture dissociation (ECD) involves the reaction of electrons with gas-phase peptides or proteins having multiple positive charges (Zubarev, R. A., Kelleher, N. L., McLafferty, F. W. J. Am. Chem. Soc. 1998, 120, 3265-3266; Cooper, H. J., Hakansson, K., Marshall, A. G. Mass Spectrometry Reviews 2005, 24, 201-222). Energy released during the capture of an electron by a multiply-charged peptide/protein ion may result in cleavage of its backbone, generally without disturbing its PTMs. In ECD, multiply-charged positive ions are normally formed by electrospray ionization (ESI) at atmospheric pressure, then transferred into the high vacuum of an FT-ICR mass analyzer where they are trapped, fragmented by reactions with electrons, and then detected. This original ECD method requires both positive ions and electrons to be simultaneously confined in the same spatial volume, generally requiring the use of a Penning ion trap, where confinement of charged particles relies upon the strong magnetic field provided by an expensive super-conducting magnet, an integral component of FT-ICR mass spectrometers. Consequently, though powerful, the original ECD method suffers from the substantial shortcoming of requiring highly expensive, specialized instrumentation.

Electron transfer dissociation (ETD) is very similar to ECD, but uses anions in place of electrons as the negative reagents (Syka, J. E. P., Coon, J. J., Schroeder, M. J., Shabanowitz, J., Hunt, D. F. Proc. Natl. Acad. Sci. USA 2004, 101, 9528-9533; Hunt, D. F., Coon, J. J., Syka, J. E. P., Marto, J. A. United States Patent Application Pub. No.: US2005/0199804A1). With ETD, generally, positively charged peptide/protein ions from an ESI source at atmospheric pressure are delivered into some form of electrodynamic ion trap in the vacuum system of a mass spectrometer, where they are confined and then reacted with anions from a supplemental ion source. The anions transfer electrons to peptide/protein ions and induce fragmentation in much the same manner as in direct ECD. A benefit of ETD relative to ECD is that it can be performed using relatively inexpensive quadrupole ion trap mass spectrometers, capable of simultaneously storing both positively charged peptide ions and anionic reagents (though not electrons) through the use of a dynamic electric field in place of a strong magnetic field. Like ECD, ETD has been demonstrated to be well-suited for providing information on the amino acid sequences of peptides, as well as the identity and site of labile PTMs. However, also like ECD, ETD suffers from the drawback of requiring expensive specialized mass spectrometers, which must include a means of simultaneously trapping both peptide ions and anionic reagents within the vacuum system of the mass analyzer, in addition to a supplemental means of anion production.

An alternate approach to performing ECD or ETD would be to react the peptide/protein ions with electrons or anions in the ion source of the mass spectrometer, at atmospheric pressure, outside the vacuum system of the mass analyzer. A practical method of performing in-source ECD or ETD at atmospheric pressure would have an advantage over conventional ECD/ETD methods in that dedicated mass spectrometers equipped with specialized ion trapping capabilities, as well as supplemental electron/anion production means, would not be required. All manner of mass analyzers, including those not originally designed for ECD/ETD experiments, could potentially be outfitted or retrofitted with an atmospheric pressure (AP) ECD/ETD source. Such a device would potentially make the powerful ECD/ETD technology more widely accessible, as researchers wishing to perform ECD/ETD on their peptide/protein samples would not need to acquire entire new instruments dedicated to the task.

To date, there have been two published reports of peptide ions being fragmented at atmospheric pressure through an ECD/ETD-like process (Delobel, A., Halgand, F., Laffranchise-Gosse, B., Snijders, H., Laprévote, O. Anal. Chem. 2003, 75, 5961-5968; Debois, D., Giuliani, A., Laprévote, O. J. Mass Spectrom. 2006, 41, 1554-1560). These reports came out of fundamental studies of fragmentation mechanisms active within a conventional PhotoSpray™ atmospheric pressure photoionization (APPI) source from AB Sciex (Concord, Ontario, Canada). The reports described how in the PhotoSpray™ source multiply-charged peptide ions from its pneumatic heated nebulizer may be transported by a flow of gas to a downstream photoionization region, where photoionization of an ionizable component of the gas produces photoelectrons, which may then be captured by the peptide ions and cause AP-ECD; ultimately, ions exiting the ion source—including the ECD products—are delivered through the atmosphere-vacuum interface of the mass spectrometer for mass analysis and detection. The significance of these early reports is that they served to demonstrate that ECD/ETD reaction products may be created at atmospheric pressure and then delivered intact into the vacuum system of the mass spectrometer; however, the researchers to first observe the phenomenon made no efforts to study or develop AP-ECD as a practical tool for peptide/protein structural characterization. This is attributable in part to the facts that the quality (general appearance and information content) of the AP-ECD spectra obtained were poor and that quantities of sample far in excess of those normally used in protein mass spectrometry were consumed to generate the spectra. Hence, it appears that the sensitivity of AP-ECD as originally demonstrated was too low for it to be recognized as a potential alternative to conventional ECD/ETD methods.

The low sensitivity of the original AP-ECD method is at least in part attributable to the nature of the means of peptide ion production, the heated nebulizer probe, designed and normally used to vaporize liquid sample streams bearing neutral analytes, to be ionized subsequently via separate means such as APPI. Since all the components of the heated nebulizer probe are at ground potential—including the internal pneumatic sprayer for nebulizing the liquid sample stream—there is no electric field in the nebulizer to promote charging of the liquid and thereby promote the formation of multiply-charged peptide/protein ions. The peptide ions that are generated directly from conventional heated nebulizers preexist in solution, and are liberated into the gas phase from droplets formed with a net charge during nebulization, as a result of statistical variations in the number of oppositely charged ions within each droplet. Droplet charging through random fluctuations in ion populations is a very inefficient process relative to the deliberate charging of the liquid via electrical means as is the norm in ESL At first glance, it may then appear a simple matter to increase the initial yield of peptide/protein ions for subsequent AP-ECD via photoelectrons, by replacing the grounded heated nebulizer of the APPI source with an ESI source. However, there have been no prior examples of electrifying the sprayer of a conventional heated nebulizer, to promote peptide/protein ionization, which would require substantial redesign and modification of existing hardware never intended to be electrified. Further, in one prior case where a dual-mode ion source coupling conventional ESI and APPI was used in the analysis of peptide/protein samples, when the APPI source was on, large suppressions of the ESI multiply-charged ions were observed, with no sign of ECD/ETD fragment ions (Syage, J. A., Hanold, K. A., Lynn, T. C., Horner, J. A., Thakur, R. A. J. Chromatogr. A 2004, 1050, 137-149). Altogether, then, the prior art surrounding AP-ECD does not suggest a straightforward means of increasing the sensitivity of the method to make it a viable alternative to regular ECD/ETD.

There has been one other prior mention of using an electron-based fragmentation method at atmospheric pressure as a tool for peptide/protein characterization (Whitehouse, C., White, T., Willoughby, R., Sheehan, E. United States Patent Application Pub. No.: US2006/0255261A1). In this case, an apparatus was envisioned in which the sprayed ions from two or more liquid inlet probes are mixed at atmospheric pressure, and in which one of the probes produces multiply-charged positive peptide/protein ions while another produces anionic reagents for ETD. Though on its surface such an apparatus may appear straightforward to implement and potentially viable, in practice there is a problem with the design which limits its efficiency, at least, and possibly prevents its successful operation altogether. The problem is that the two liquid inlet probes are situated in close proximity in an open spatial volume. Such a configuration is highly unfavorable for effecting ECD/ETD, as the strong electric field of the ESI probe used to generate positive ions will be experienced by the electrons/anions from the other probe, resulting in the negatively charged reagent ions being drawn towards the ESI probe, rather than towards the individual peptide/protein ions to be fragmented. This occurs because the electric field in the vicinity of the probe is much greater than that of individual positive ions. Negative reagents reaching the ESI probe will be neutralized there, possibly quenching the electrospray as a result of the accompanying voltage drop (due to the current from neutralizing negative charges), and definitely removing the negative reagents required for ETD. Though it may be possible to circumvent these problems by situating the two probes far apart, so that the ions from each meet in a region remote from the ESI source probe, where the electric field from the probe is diminished, this will inevitably result in poor transmission of ions into the reaction region and then into the mass analyzer. This is because positive ions initially follow divergent trajectories from the ESI probe and no means of guiding the ions to the reaction region has been included in the prior design. It is perhaps then no coincidence that no results have yet been presented for the multiple-probe AP-ETD source envisioned.

In summary, both ECD and ETD have been proven to be powerful fragmentation techniques for the mass spectrometric analysis of peptides/proteins, though each of these techniques require expensive, specialized equipment. An atmospheric pressure ECD/ETD method would have the advantages of requiring relatively less expensive hardware and would be suitable for use with all manner of mass analyzers, including those not expressly designed for ECD/ETD experiments. However, only a couple of AP-ECD/ETD methods have been reported, and none has been shown to be a viable alternative to conventional ECD/ETD techniques.

SUMMARY OF THE INVENTION

An object of one aspect of the present invention is to provide an improved in-source atmospheric pressure-electron capture dissociation (AP-ECD) method and apparatus for mass spectrometric analysis of peptides and proteins.

What the present inventor has realized is that atmospheric pressure ECD/ETD can be an effective and highly sensitive method for mass spectrometric analysis of peptide and protein samples. The present invention uses an electrified sprayer to generate multiply-charged peptide/protein ions from a sample solution, a source of electrons or anions for ECD/ETD reagents, and a guide and a flow of gas for guiding positively charged ions from the electrified sprayer to a downstream reaction region within the guide, the reaction region being at or near atmospheric pressure and substantially free of the electric field from the electrified sprayer. Positive ions exiting the reaction region are subsequently passed into the mass analyzer of the mass spectrometer for mass analysis of the ions.

The present invention may be applied to sample solutions comprised of a solvent and one or more analytes. Preferably, the sample solution is subjected to a liquid chromatography step before introduction into the electrified sprayer to separate each analyte from other substances in the solution.

The use of an electrified sprayer is important for achieving high sensitivity with the method, as electrified sprayers are one of the best means of generating multiply-charged peptide/protein ions from a sample solution at atmospheric pressure. The electrified sprayer is preferably a nanospray emitter, but other types of sprayers may also be used, including electrospray, microspray, and electrosonic-spray sources. The electrified sprayer may also be an "ionspray" source, using pneumatic assistance, whereby a flow of gas aids in nebulization and vaporization of the liquid sample. Heat may also be applied to the spray, to assist in vaporization of the liquid sample, through any number of known means, including the use of a pre-heated nebulizer or auxiliary gas.

The use of a guide and a flow of gas for guiding the positively charged ions to a downstream reaction region within the guide is important for obtaining high sensitivity with the method. The guide and the flow of gas serve to deliver positively charged analyte ions from the electrified sprayer to the downstream reaction region with a minimum of ion losses. The guide may be a tube, channel, or conduit, or other similar means of confining and directing a flow of gas. The guide may have a single section or it may have several connected sections. Preferably, at least one section of the guide is heated, to promote vaporization of charged droplets from the sprayer and also possibly to increase the ECD/ETD fragmentation efficiency, which can be temperature dependent. Preferably, the gas used to transport the positively charged analyte ions within the guide is nitrogen, containing a minimum of impurities including oxygen, since the presence of air in the reaction region has been shown to reduce the fragmentation efficiency of the method.

The negatively charged species used to dissociate the multiply-charged positive ions may be either electrons or anions. In the case where electrons are the negatively charged species, the method uses electron capture dissociation (ECD). When anions are the negatively charged species, the method uses electron transfer dissociation (ETD). Such anions can be formed via a number of means of primary electron generation, including those described below, with an additional step of providing a neutral species capable of first capturing the primary electrons and then transferring these electrons to the positively charged ions. In this case, the neutral species capturing the electrons serves as an intermediate in the dissociation reaction. According to the present method, either of ECD or ETD may be used, since their fragmentation performance is often very similar. In some cases both ECD and ETD will be active. In some cases it can be difficult to determine which process is actually most responsible for the results, as free electrons may be captured by neutral impurities in the reaction zone, resulting in ETD, ultimately, even when an ETD reagent is not deliberately added. A preferred embodiment uses ECD, as it is simple to implement and effective. The negatively charged species production means produces either electrons to be reacted with the positively charged ions, or anions to be reacted with the positively charged ions, or in some cases both electrons and anions may be produced that can react with the positively charged ions.

The reagent electrons may be formed by photoionization of an ionizable gas-phase species, resulting in the production of photoelectrons. The photoionizable gas-phase species may be added intentionally to promote photoionization and thus electron production, in which case it is termed a "dopant." Alternatively, the photoionizable species may be a volatile component of the solvent carrying the sample. Yet another alternative is that photoelectrons may be generated from a solid surface directly, by the photoelectric effect, so that no gas-phase ionizable species need be utilized. Still another alternative is that an electrical discharge, such as a corona discharge, may be used to generate electrons; however, this requires the use of a supplemental high electric field, which may disturb the production and transmission of positive ions, unless the discharge is situated remotely and negative reagents are transported to the reaction zone. Preferably, reagent electrons are formed by photoionization of a suitable dopant, such as toluene or acetone, directly within the reaction region; by controlling the concentration of dopant in the reaction region, the quantity of photoelectrons generated can be controlled, providing a facile means of controlling the extent of the ECD reaction.

The photon source for photoelectron generation is preferably a gas discharge lamp, such as a Krypton discharge lamp, having continuous output. Krypton discharge lamps produce high energy photons capable of generating photoelectrons from many substances, and they are inexpensive and compact. Alternatively, the photon source may be a laser or some other means. The lamp or laser may also be pulsed, though continuous output is often preferred.

Photoionization processes are preferred, though other ionization methods can be used to produce the negatively charged species. Examples include a radioactive source, emitting either electrons directly (beta particles) or else ionizing particles or radiation, and Penning ionization, whereby an electronically-excited metastable species is allowed to react with a species having relatively low ionization energy (IE), causing ionization of the low IE species and liberation of an electron. Suitable metastable species are ordinarily formed in some type of electrical discharge.

The negatively charged species are mixed with the positively charged ions in a reaction region to cause ECD/ETD. The negatively charged species may be formed directly in the reaction region, so that no additional mixing step is required, as is preferred, or else they may be formed in an adjacent or remote region and then transported into the reaction region. In the event that the negatively charged species are formed outside the reaction region, a tributary flow of gas through an opening in the guide may be used to transport the negatively charged species into the reaction region of the guide.

It is important that the reaction region of the guide be substantially free of the electric field from the electrified sprayer. This is because the electric field from the sprayer is capable of attracting negatively charged reagents to the sprayer, adversely affecting the production of positive ions and also eliminating ECD/ETD reagents. Shielding the reaction region from the electric field of the sprayer may be achieved by several means, including making the guide of sufficient length that the sprayer is sufficiently remote from the reaction region that the field does not substantially reach the reaction region. Alternatively, a wire screen at the potential of the reaction region may be included between the sprayer and the reaction region, or a curve may be included in the guide between the sprayer and the reaction region, or any of the above solutions may be used in combination. It is generally preferable to minimize the separation of the electrified sprayer from the reaction region—to minimize transport losses—and then to screen the reaction region from the electric field of the sprayer with a high-transmission wire mesh at the potential of the reaction region.

It is generally preferred that the guide section enclosing the reaction region should be held at an electrical potential below that of the electrified sprayer and above that of the entrance of the atmosphere-vacuum interface of the mass spectrometer. This is to maximize the transmission of positive ions from the electrified sprayer to the reaction region, and then into the mass analyzer of the mass spectrometer.

The advantages of the present invention over prior in vacuo ECD/ETD methods are that it does not require a means of trapping the ions in the mass spectrometer and it can be used with mass spectrometers not expressly designed to perform ECD or ETD, making ECD/ETD a lower cost, potentially more accessible technique. The advantage of the present invention over the one prior atmospheric pressure ECD/ETD method to be demonstrated is that it is much more sensitive, enabling detection of ECD/ETD fragment ions from much smaller quantities of peptide/protein samples, through much improved generation and transmission of peptide/protein ions.

BRIEF DESCRIPTION OF THE DRAWINGS

The present invention will be further understood from the following description with reference to the accompanying drawings of two representative AP-ECD ion sources according to the invention, in which all views are schematic and may not be to scale.

Figure 1:
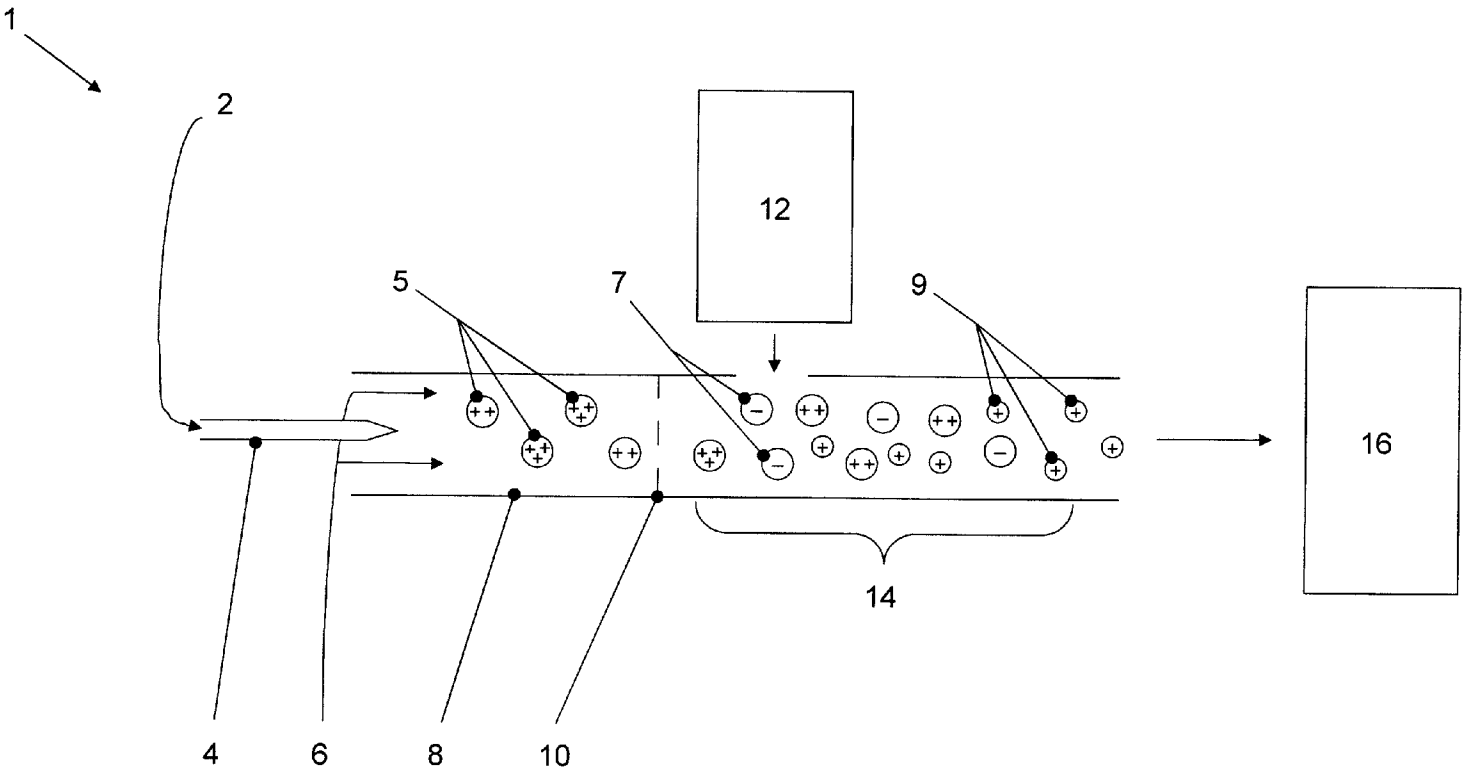
FIG. 1, in plan view, illustrates a schematic diagram of an embodiment of the method of the invention.

In the drawings, preferred embodiments of the AP-ECD ion source according to the invention are illustrated by way of example. It is to be understood that the description and drawings are only for the purpose of illustration and as an aid to understanding, and are not intended to be a constraint on the limits of the invention.

DETAILED DESCRIPTION

Referring to FIG. 1, there is illustrated a schematic diagram for an in-source atmospheric pressure electron capture dissociation (AP-ECD) method for mass spectrometric analysis of peptide and protein samples (1) in accordance with an embodiment of the present invention. A liquid sample (2) is introduced into an electrified sprayer (4) by which gas-phase positively charged analyte ions having multiple positive charges (5) are produced. The positively charged analyte ions (5) are swept from the electrified sprayer (4) by a flow of gas (6) through a guide (8) for guiding the positively charged analyte ions (5) towards a downstream reaction region (14) within the guide (8). A wire screen (10) is situated within the guide (8) between the electrified sprayer (4) and the reaction region (14) to shield the reaction region (14) from the electric field of the electrified sprayer (4). Negatively charged species (either electrons or anions) (7) are generated using a negatively charged reagent production means (12). The negatively charged reagent production means (12) is situated downstream of the electrified sprayer (4) such that the negatively charged species (7) that are produced therefrom intersect the positively charged ions (5) in the reaction region (14). In one embodiment of the invention, the negatively charged species (7) are produced within the reaction region (14). In another embodiment of the invention the negatively charged species (7) are produced outside of the reaction region (14) and then subsequently introduced into the reaction region (14). The positively charged ions (5) are mixed with the negatively charged species (7) in the reaction region (14) at or near atmospheric pressure. This mixing of the charged species results in fragmentation of at least a portion of the positively charged ions, via ECD or ETD or both processes, to produce fragment ions (9) which are then passed into a mass analyzer (16) of a mass spectrometer. It is expressly understood that the arrangement of the elements of the method as depicted in FIG. 1 are for illustration only and should not be construed to limit the geometrical arrangement of the various elements of the invention. Various geometrical and spatial arrangements of the elements and the means of connecting the elements are possible.

Figure 2:
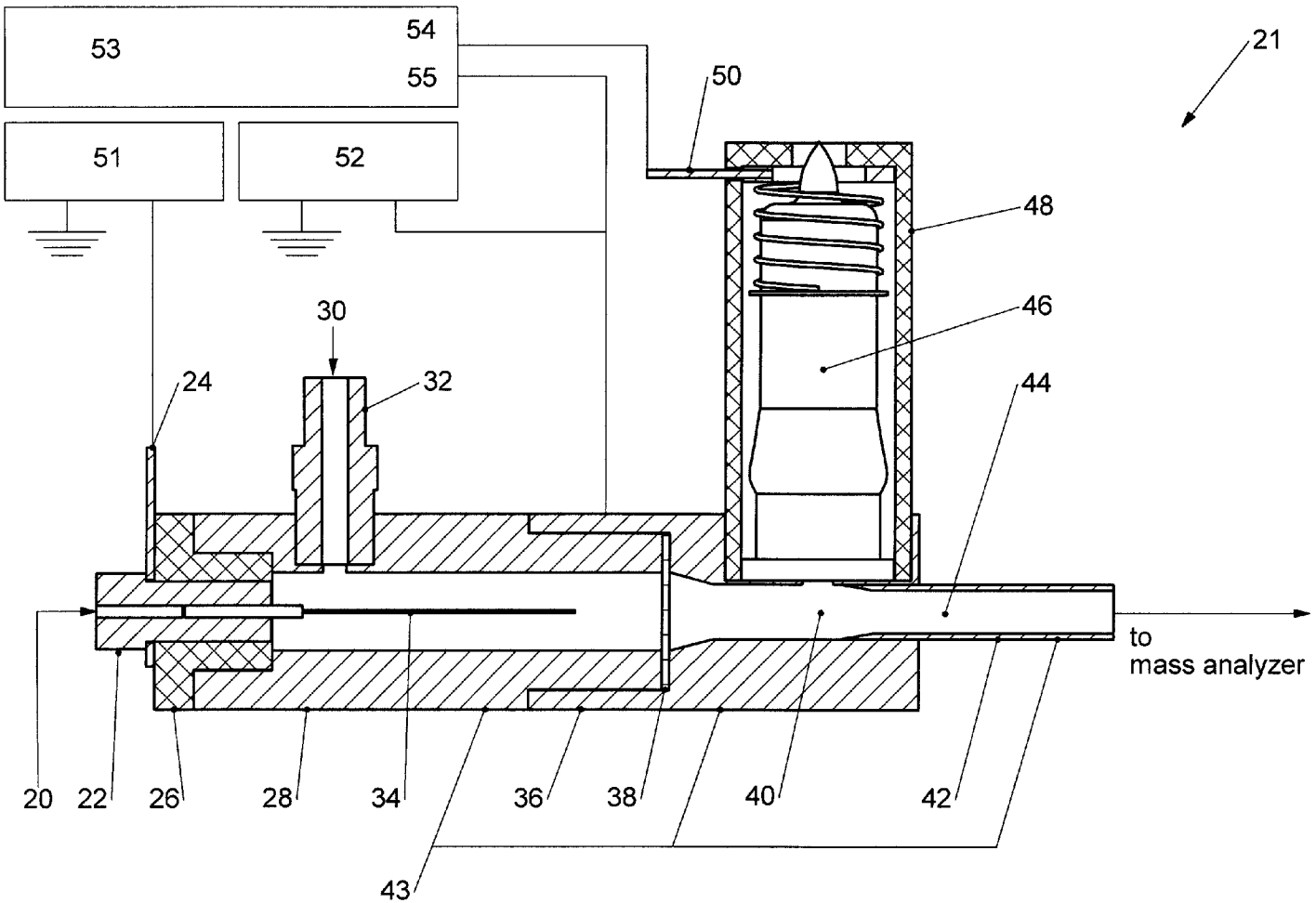
FIG. 2, in cross-sectional view, illustrates an embodiment of the apparatus of the present invention including a nanospray emitter.

Referring to FIG. 2, an apparatus (21) in accordance with a preferred embodiment of the present invention is shown. The major features of the apparatus (21) comprise a nanospray emitter (34) for producing positively charged analyte ions, a gas-discharge lamp (46) for producing negative reagents (photoelectrons), a flow of gas (30) and a hollow guide (43) comprised of three connected sections each having a central channel, namely, a first guide section (28), a second guide section (36) and a third guide section (42), the hollow guide (43) for guiding the positively charged analyte ions, and a high-transmission wire mesh (38) located between the first guide section (28) and the second guide section (36), said wire mesh (38) designed and configured to screen a reaction region (44) of the guide (43) from the electric field of the nanospray emitter (34). The reaction region (44) is located downstream of the nanospray emitter (34) within the central channel of the hollow guide (43).

Now describing the apparatus (21) of FIG. 2 in detail, a liquid sample (20) is introduced into a stainless-steel union (22) for coupling the liquid sample (20) to the nanospray emitter (34). The union (22) allows for standard 1/16" OD tubes to be joined on each side, with minimal dead-volume therebetween. The liquid sample (20) is delivered into the union (22) from the upstream side thereof, while the fused silica nanospray emitter (34) is fixed to the downstream side of the union (22). The union (22) is mounted and fastened within an electrically-insulating polyimide plug (26) which plug (26) is removably inserted into the central channel of the first section (28) of the stainless-steel guide (43) from the upstream end. The plug (26) is designed and configured to be removable from the first guide section (28) so as to provide easy access to the nanospray emitter (34) in case the nanospray emitter (34) must be replaced. The union (22), the plug (26) and the first guide section (28) are all mounted such that a substantially hermetic seal is maintained between the central channel of the first guide section (28) and the outside atmosphere, to prevent air from entering the guide (43) and to prevent the contents of the guide (43) from escaping. A stainless-steel electrode (24) connected to a first high voltage power supply (51) is held in electrical connection with the union (22) before the plug (26); the electrode (24) is provided simply as a means of connecting the first power supply (51) to the union (22). The liquid sample (20), the union (22) and the electrode (24) are all in electrical contact, so that the liquid sample (20) is electrified during transit through the union (22), which ultimately leads to the formation of positively charged analyte ions at the exit of the nanospray emitter (34).

A flow of gas (30), introduced and directed substantially perpendicularly to the hollow guide (43) is introduced into the first guide section (28) through a stainless-steel union (32) coupling the first guide section (28) and the source for the flow of gas (30). One end of the union (32) accepts a standard ⅛" OD tube used to deliver the flow of gas (30), while the other end is threaded for mating with a matching tapped hole in the first guide section (28). Positive ions exiting the downstream end of the nanospray emitter (34) are guided through the first guide section (28) by the flow of gas (30). The gas (30) preferably consists of pure nitrogen doped with a volatile photoionizable species such as acetone or toluene. As the gas (30) enters the guide (43), the gas (30) envelopes the nanospray emitter (34) within the first guide section (28) so that ions exiting the emitter are swept through the guide (43) by the gas (30). The inner diameter of the first guide section (28) is relatively large (10 mm in this embodiment) so that the velocity of the gas (30) at a given flow rate (typically around 10 l $min^{-1}$) around the nanospray emitter (34) is relatively low, which helps prevent the gas flow (30) from disrupting the electrospray plume at the tip of the emitter (34).

A stainless-steel high-transmission wire mesh (38) is situated downstream of the nanospray emitter (34), between the first (28) and second (36) guide sections and in electrical connection therewith. The second guide section (36) is connected to a second high voltage supply (52). The first guide section (28), the wire mesh (38) and the second guide section (36) are all in electrical contact and are all held at the same electrical potential. The potential of the first high voltage power supply (51) is greater (more positive) than that of the second high voltage supply (52), to provide a strong electric field between the tip of the nanospray emitter (34) and the first section of the guide (28), as well as the wire mesh (38), and thereby to promote electrospray ionization of the liquid sample (20) as well as to assist in the delivery of positive ions downstream. Openings in the wire mesh (38) permit positive ions to be transmitted by the gas flow (30) into the downstream second (36) and third (42) guide sections. Because the wire mesh (38) and the surfaces of the neighboring downstream guide sections (36, 42) are all at the same electrical potential, the reaction region (44) of the guide (43) is substantially field-free, effectively shielded from the electric field of the nanospray emitter (34).

The second guide section (36) has a tapered entrance to reduce the internal diameter of its central channel (down to 7 mm in this embodiment) and thereby to increase the velocity of the gas flow (30) so that the residence time of positive ions within the guide is decreased proportionally. It is desirable to minimize the residence time of positive ions within the guide so that losses of ions due to diffusion to the walls of the guide are minimized (ions encountering the walls of the guide will be neutralized, preventing their detection by the mass spectrometer).

A krypton discharge lamp (46), within an electrically-insulating cylindrical lamp holder made of polyimide (48), is mounted in the side of the second guide section (36) such that high energy photons generated in the lamp (46) are transmitted into the central channel of the second guide section (36) through an aperture in the wall of the second guide section (36). The lamp (46) receives power from a lamp power supply (53) electrically connected thereto. The negative high voltage outlet (54) of the lamp power supply (53) is in contact with an electrode (50) within the lamp holder (48) which is in electrical contact with the cathode of the lamp (46) via a metal spring. The high voltage return (55) of the lamp power supply (53) is in electrical communication with the second guide section (36) which is in communication with the anode of the face of the lamp (46) and the high voltage return (55) is also in electrical communication with the second high voltage power supply (52), effectively floating the guide (43), the lamp (46) and the lamp power supply (53) at the voltage of the second power supply (52).

High energy photons from the lamp (46) intersect the gas flow (30) bearing the positively charged analyte ions in a photoelectron/negative reagent generation region (40) within the central channel of the second guide section (36) where photoelectrons are generated via photoionization of an ionizable species doped into the gas flow (30).

Further, in the photoelectron/negative reagent generation region (40) any positively charged analyte ions in the gas flow (30) commence reacting with the generated photoelectrons resulting in ECD of at least a portion of the analyte ions having multiple positive charges. The reaction mixture is guided from the negative reagent/photoelectron generation region (40) by the flow of gas (30) into the third and final guide section (42). The third guide section (42) also has a tapered entrance to reduce the diameter of its central channel and thereby increase the gas velocity and minimize ion losses due to diffusion. The inner volume of the third guide section (42) comprises the remainder of the reaction region (44) in which ECD occurs. Upon exiting the guide (43) under the influence of the gas flow (30), positive ions are transferred into the mass analyzer of the mass spectrometer for mass analysis. This transfer is improved by maintaining the potential of the guide (43), as set by the second high voltage power supply (52), at a value greater (more positive) than that of the entrance to the atmosphere-vacuum interface of the downstream mass analyzer.

Figure 3:
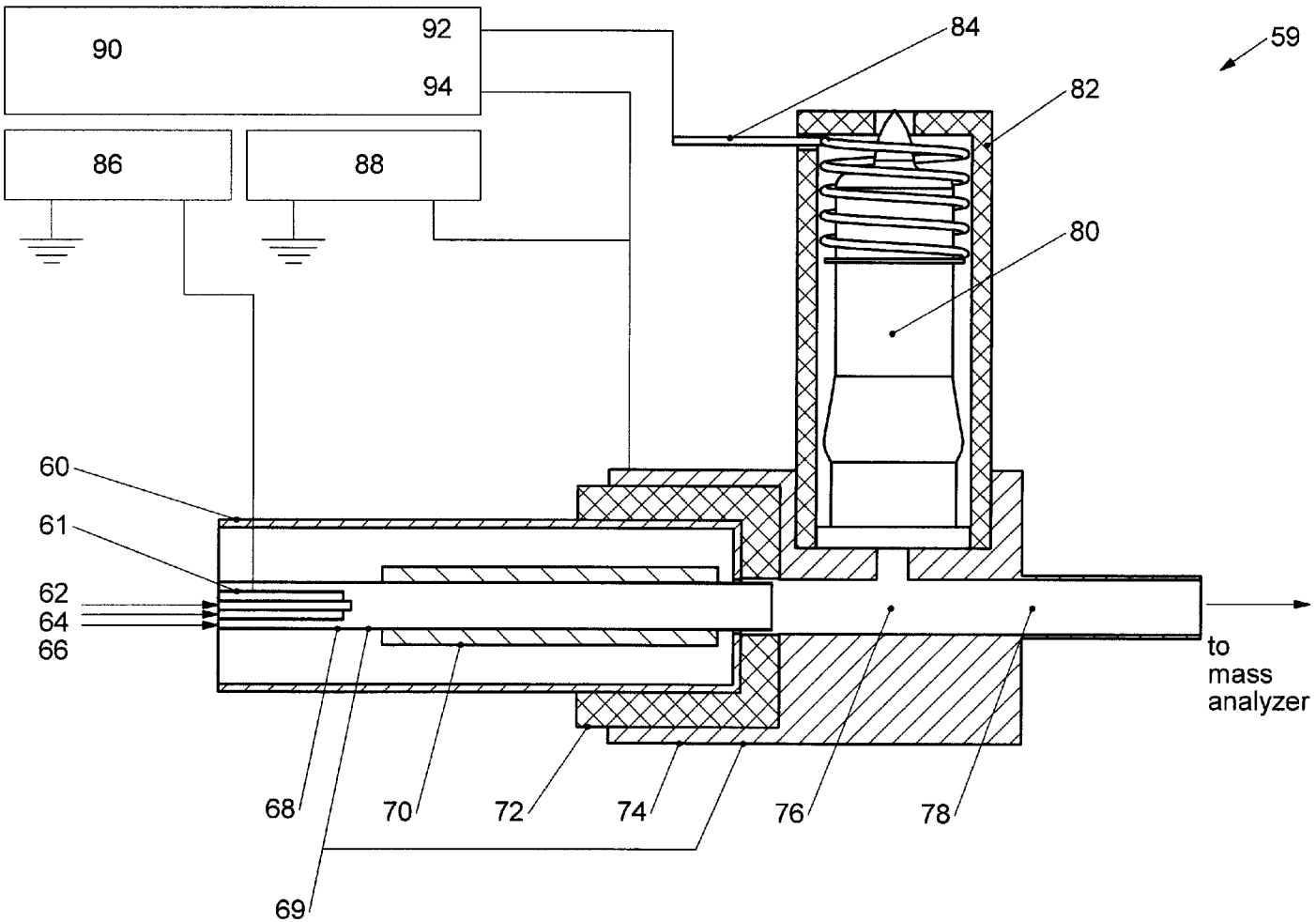
FIG. 3, in cross-sectional view, illustrates another embodiment of the apparatus of the present invention including a heated nebulizer with an electrified internal sprayer.

Referring to FIG. 3, there is presented a schematic of another embodiment of an in-source AP-ECD apparatus (59) for mass spectrometric analysis of peptides/proteins in accordance with the present invention. This apparatus (59) consists of an AB Sciex PhotoSpray™ APPI source (Robb, D. B., Covey, T. R., Bruins, A. P. Anal. Chem. 2000, 72, 3653-3659), whose heated nebulizer for forming gas-phase analyte neutral species from liquid samples has been replaced by an ElectroPneumatic-Heated Nebulizer (EPn-HN) (60) (Robb, D. B., Blades, M. W. Rapid Commun. Mass Spectrom. 2009, 23, 3394-3400), a substantially modified heated nebulizer whose internal pneumatic sprayer (61) has been electrified for forming gas-phase analyte ions from liquid samples. In addition to the EPn-HN, the other major components of the apparatus (59) are an APPI source block (74) with a krypton discharge lamp (80) for forming the negative reagents (photoelectrons) for the ECD reactions.

Now describing the apparatus (59) of FIG. 3 in detail, the EPn-HN (60) features an electrified pneumatic sprayer (61), in electrical communication with a first high voltage power supply (86), for promoting the formation of gas-phase analyte ions from the liquid sample (62). The electrified sprayer (61) is comprised of a central stainless-steel capillary tube through which the liquid sample (62) is delivered and a concentric stainless-steel tube surrounding the central capillary through which a nebulizer gas (64) flows. The purpose of the nebulizer gas (64) is to provide pneumatic assistance to the electrified sprayer (61) in nebulizing the liquid sample (62). An auxiliary gas flow (66) is also provided around the electrified sprayer (61), to assist in transporting ions from the electrified sprayer (61) through a guide (69) for guiding the positively charged ions towards a downstream reaction region (78) within the guide (69). The nebulizer gas (64) and the auxiliary gas (66) both consist of pure nitrogen, with the auxiliary gas (66) being doped with a volatile photoionizable substance, preferably acetone or toluene.

The guide (69) for guiding positively charged ions has two sections, the first of which is an elongated quartz tube (68) surrounding the electrified sprayer (61). Positively charged ions from the electrified sprayer are transported through the quartz tube (68) by the combined nebulizer (64) and auxiliary (66) gas flows. Additionally, the quartz tube (68) is surrounded by a heater (70), for heating the quartz tube (68) and its contents, and thus for enhancing the formation of gas-phase positively charged analyte ions from the charged liquid droplets initially produced by the electrified sprayer (61).

The gas-phase positively charged analyte ions generated in the EPn-HN (60) are transported downstream by the combined gas flows (64, 66) into a contiguous second guide section, comprised of the central channel of the stainless-steel APPI source block (74) mounted onto the outer shell of the EPn-HN (60). A polyimide cylindrical sleeve (72) on the end of the EPn-HN (60) electrically insulates the grounded outer shell of the EPn-HN (60) from the APPI source block (74). The APPI source block (74) is connected to a second high voltage power supply (88) and is held at a potential below that of the electrified sprayer (61) to provide a potential gradient within the device suitable for both the production and transmission of multiply-charged positive ions.

Unlike in the apparatus (21) illustrated in FIG. 2 and described above, in the apparatus (59) there is no wire mesh screen between the guide section containing the electrified sprayer (61), the quartz tube (68), and the guide section containing the reaction region (78), the central channel of the APPI source block (74). This is because the length of the quartz tube (68) is sufficient to provide enough separation between the electrified sprayer (61) and the reaction region (78) to prevent the electric field from the sprayer (61) from substantially reaching the reaction region (78).

High energy photons from the lamp (80) intersect the gas flow (64, 66) bearing the positively charged analyte ions in a photoelectron/negative reagent generation region (76) within the central channel of the APPI source block (74) where photoelectrons are generated via photoionization of an ionizable species doped into the gas flow (64, 66).

Further, in the photoelectron/negative reagent generation region (76) any positively charged analyte ions in the gas flow (64, 66) commence reacting with the generated photoelectrons resulting in ECD of at least a portion of the analyte ions having multiple positive charges. The reaction mixture is guided from the negative reagent/photoelectron generation region (76) by the flow of gas (64, 66) through the remainder of the reaction region (78) in which ECD occurs. Upon exiting the guide (69) under the influence of the gas flow (64, 66), positive ions are transferred into the mass analyzer of the mass spectrometer for mass analysis. This transfer is improved by maintaining the potential of the APPI source block (74), as set by the second high voltage power supply (88), at a value greater (more positive) than that of the entrance to the atmosphere-vacuum interface of the downstream mass analyzer.

Figure 4:
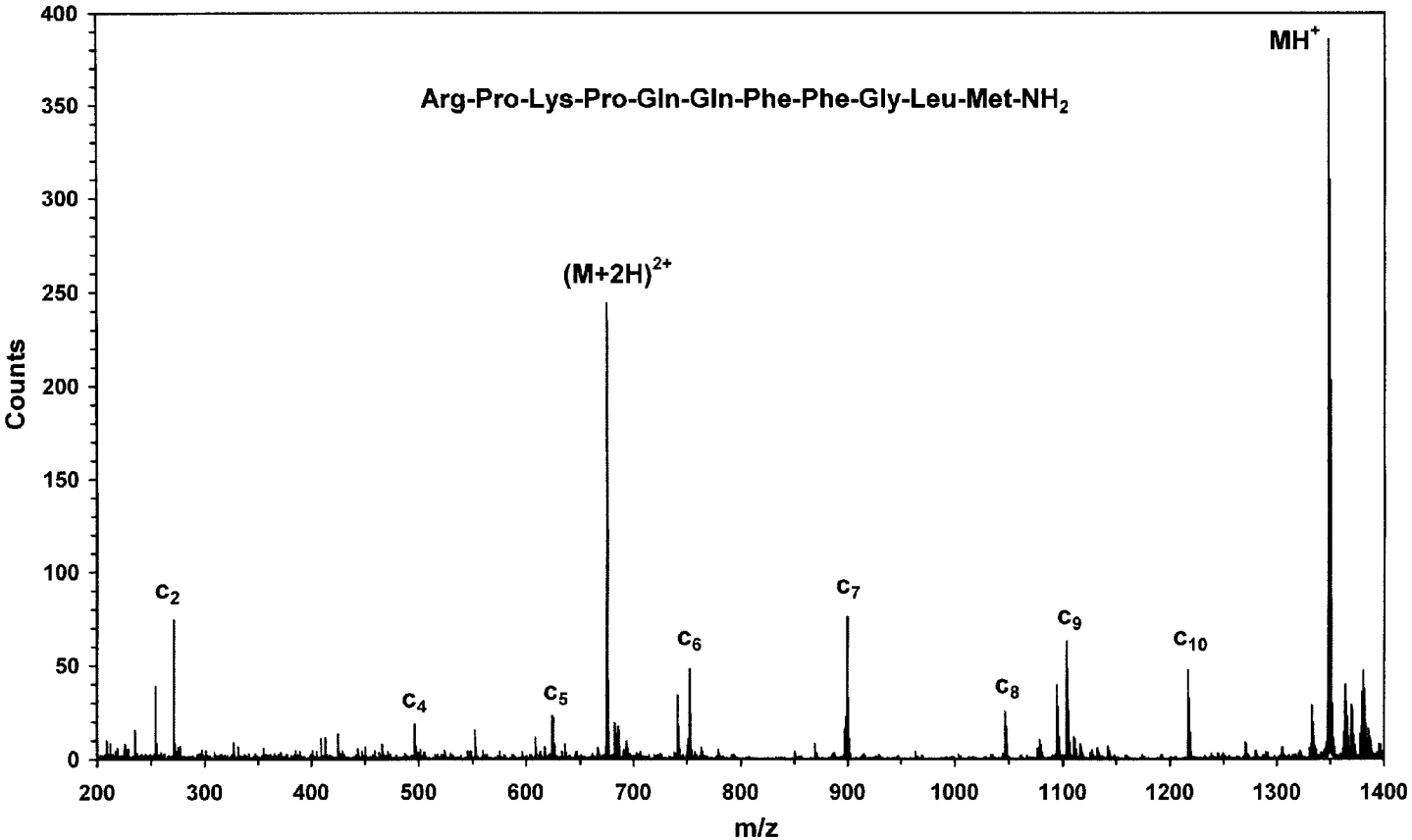
FIG. 4 illustrates an exemplary AP-ECD mass spectral trace of the peptide Substance P obtained using an embodiment of the present invention.

Referring to FIG. 4, there is illustrated an exemplary mass spectral trace obtained using an embodiment of the present invention of Substance P, a peptide commonly used to characterize ion-fragmentation techniques. For this example, the AP-ECD source was a PhotoSpray™ APPI source from AB Sciex, equipped with an EPn-HN, as described above, and the mass spectrometer used was an unmodified QStar XL™, also from AB Sciex. The liquid sample was a 2 μM solution of Substance P in a solvent of 50/50, methanol/water. The liquid sample was delivered at 1 μl $min^{-1}$, corresponding to a sample mass flow rate of 2 pmol $min^{-1}$. The spectrum displayed is the average of 5 scans, each of 0.6 second duration, over 3 seconds; hence, 100 fmol of Substance P were consumed to generate the spectrum. The spectrum of FIG. 4 clearly shows Substance P's series of c-ion fragments ($c_2$, $c_4$-$c_{10}$), characteristic of ECD/ETD, as well as unfragmented doubly $[(M+2H)^{2+}]$ and singly ($MH^+$) protonated molecular ions of Substance P. Significantly, the sensitivity obtained in the present example is at least 100× better than obtained using the only prior art AP-ECD method (Debois, D., Giuliani, A., Laprévote, O. J. Mass Spectrom. 2006, 41, 1554-1560), and is now comparable to that obtained in conventional ECD methods employing highly expensive FT-ICR instruments (Cooper, H. J., Hakansson, K., Marshall, A. G. Mass Spectrometry Reviews 2005, 24, 201-222).

Other variations and modifications of the invention are possible and aspects of some of these have been described above. For example, the liquid sample stream may be composed of a solution of sample in a solvent or solvent mixture, and the solvent or other additives may be used to provide a volatile component that is photoionizable to produce the gas phase electrons. In addition, a variety of electrified spray means may be employed, and a variety of negatively charged species production means may be employed in the practice of the invention. As well, the negatively charged species can be produced within the reaction region, or can be produced outside of the reaction region and then subsequently introduced into the reaction region. The electrified sprayers described above are but two of a number of different possible electrified spray means that can be employed in accordance with the invention. Electrified spray means include nanospray, electrospray, microspray, electrosonic spray and ionspray. All such modifications or variations and others that will occur to those skilled in the design of such systems are considered to be within the sphere and scope of the invention as defined by the claims appended hereto.

What is claimed is:

1. A method of analyzing a sample of an analyte, the method comprising:

(1) providing a sample solution comprising a solvent and the analyte as a sample stream;

(2) forming gas-phase analyte ions having multiple positive charges by passing the sample stream through an electrified sprayer;

(3) providing a flow of gas and a guide for guiding positively charged analyte ions from the electrified sprayer to a downstream reaction region within the guide, wherein the reaction region is substantially free of an electric field from the electrified sprayer;

(4) providing gas-phase negatively charged species by a means for forming gas-phase negatively charged species, said gas-phase negatively charged species for reaction with gas-phase positively charged analyte ions;

(5) introducing the negatively charged species to the reaction region within the guide and wherein the reaction region is at or near atmospheric pressure;

(6) reacting positively charged analyte ions with the negatively charged species in the reaction region within the guide, thereby causing fragmentation of at least a portion of the positively charged analyte ions, said fragmentation occurring by at least one of electron capture dissociation and electron transfer dissociation; and (7) passing the positively charged ions from the reaction region of the guide into a mass analyzer of a mass spectrometer for mass analysis of the ions.

2. The method of claim 1, wherein the electrified sprayer comprises a capillary wherein the capillary is selected from the group consisting of a metal capillary with a voltage applied thereto and a fused silica capillary with a voltage applied to the sample stream through a metal contact.

3. The method of claim 2, which includes, in step (2), providing a flow of gas around the capillary of the electrified sprayer through a coaxial capillary to provide pneumatic assistance to the electrified sprayer in nebulizing a liquid sample stream.

4. The method according to claim 1, wherein the guide for guiding the gas-phase positively charged analyte ions comprises at least one channel section.

5. The method of claim 4, wherein at least one of the at least one channel section of the guide for guiding the gas-phase positively charged analyte ions is heated.

6. The method according to claim 1, wherein, in step (4), the means for forming gas-phase negatively charged species forms electrons and wherein the means for forming the electrons is selected from the group consisting of photoionization of a gas-phase neutral species, Penning ionization of a gas-phase neutral species, and irradiation of a solid surface to induce a photoelectric effect.

7. The method according to claim 1, wherein, in step (4), the means for forming gas-phase negatively charged species forms ions by chemical ionization reactions, said chemical ionization reactions following generation of primary electrons by a means for generation of primary electrons, said means for generation of primary electrons selected from the group consisting of photoionization of a gas-phase neutral species, Penning ionization of a gas-phase neutral species, irradiation of a solid surface to induce a photoelectric effect, and a gas-phase electrical discharge.

8. The method according to claim 1, including, in step (4), forming the gas-phase negatively charged species within the reaction region of the guide.

9. The method according claim 1, including, in step (4), forming the gas-phase negatively charged species outside the reaction region of the guide, and further including, in step (5), providing a tributary flow of gas through an opening in said guide to pass said negatively charged species into the reaction region.

10. The method according to claim 1, including providing at least one wire screen within the guide to shield the reaction region within the guide from the electric field of the electrified sprayer.

11. The method according to claim 1, including providing at least one bend, curve or turn in the guide to shield the reaction region from the electric field of the electrified sprayer.

12. An apparatus for preparing fragment ions from a sample of an analyte, for subsequent mass analysis in a mass spectrometer, the apparatus comprising:

an electrified sprayer for forming gas-phase analyte ions having multiple positive charges from a sample solution;

a guide and gas supply for guiding positively charged analyte ions from the electrified sprayer to a downstream reaction region within the guide, wherein the reaction region is substantially free of an electric field from the electrified sprayer; and a means for forming gas-phase negatively charged species for reaction with the gas-phase positively charged ions;

wherein positively charged analyte ions and the negatively charged species react in the reaction region, causing fragmentation of at least a portion of the positively charged analyte ions, said fragmentation occurring by at least one of electron capture dissociation and electron transfer dissociation, and wherein said reaction region is at or near atmospheric pressure.

13. The apparatus according to claim 12, wherein the electrified sprayer comprises a capillary and wherein the capillary is selected from the group consisting of a metal capillary with a voltage applied thereto and a fused silica capillary with a voltage applied to a sample stream through a metal contact.

14. The apparatus according to claim 12, wherein the guide for guiding gas-phase positively charged analyte ions comprises at least one channel section.

15. The apparatus according to claim 14, wherein at least one of the at least one channel section of the guide for guiding gas-phase positively charged analyte ions is heated.

16. The apparatus according to claim 12, wherein the means for forming gas-phase negatively charged species is comprised of a means of generating primary electrons, and wherein said means of generating primary electrons is selected from the group consisting of a gas-discharge lamp, a laser, an electrical discharge, and a radioactive foil.

17. The apparatus according to claim 12, wherein the gas-phase negatively charged species are formed within the reaction region of the guide.

18. The apparatus according to claim 12, wherein the gas-phase negatively charged species are formed outside the reaction region of the guide, then passed through an opening in said guide by a tributary flow of gas.

19. The apparatus according to claim 12, wherein at least one wire screen within the guide is provided to shield the reaction region within the guide from the electric field of the electrified sprayer.

20. The apparatus according claim 12, wherein the guide is provided with at least one bend, curve or turn to shield the reaction region from the electric field of the electrified sprayer.

* * * * *